US006338344B1

(12) United States Patent
Sinohui, Jr.

(10) Patent No.: US 6,338,344 B1
(45) Date of Patent: Jan. 15, 2002

(54) CHAIR DEVICE FOR ENHANCING SEXUAL INTIMACY

(76) Inventor: Andres Sinohui, Jr., 201 W. Dale St., Beaumont, CA (US) 92223

( * ) Notice: Subject to any disclaimer, the term of this patent is extended or adjusted under 35 U.S.C. 154(b) by 0 days.

(21) Appl. No.: 09/514,519

(22) Filed: Feb. 28, 2000

(51) Int. Cl.[7] ..... A61G 15/00
(52) U.S. Cl. ..... 128/845; 600/38
(58) Field of Search ..... 128/845, 846, 128/869, 870; 600/38; 297/445.1, 411.42, 411.44

(56) References Cited

U.S. PATENT DOCUMENTS 3,874,729 A 4/1975 Blodee
5,389,062 A 2/1995 Mitchum, Jr.
5,453,080 A 9/1995 Mitchum, Jr.
5,704,894 A 1/1998 Boutos

*Primary Examiner*—Michael A. Brown
(74) *Attorney, Agent, or Firm*—Eric Karich

(57) ABSTRACT

A chair device for facilitating sexual intimacy between a person and his or her sexual partner has a base attached to a back support frame and four legs. The chair device closely resembles and functions as an ordinary chair when resting in an upright position on its legs. When the chair device is turned over to an inverted position, the chair device is supported by the back support frame and an arm supporting means. In this inverted position, the base provides a padded reclining surface for supporting a person in a position that facilitates sexual intimacy with a sexual partner.

8 Claims, 5 Drawing Sheets

CHAIR DEVICE FOR ENHANCING SEXUAL INTIMACY

This application for a utility patent is a continuation-in-part of a previously filed utility patent, now abandoned, having the application Ser. No. 09/240,916, filed Jan. 29, 1999.

BACKGROUND OF THE INVENTION

1. Field of the Invention

This invention relates generally to sexual aids, and more particularly to a chair device that appears to be an ordinary chair, but can be inverted for use to facilitate sexual relations.

2. Description of Related Art

Chair devices usefully for facilitating sexual relations are known in the art. However, such devices have typically been obtrusive contraptions that are obviously sexual in nature. Craft, U.S. Pat. No. 5,538,011, for example, discloses an outlandish folding chair with protruding stirrups. Other examples of such devices are shown in Boutos, U.S. Pat No. 5,704,894 and Mitchum, Jr., U.S. Pat. No. 5,389,062 and 5,453,080. Since most people do not want such contraptions in their home or office for fear of embarrassment, the prior art devices have not succeeded in fulfilling the market's need for an entertaining sexual device.

Ordinary chairs are also well known in the art. Blodee, U.S. Pat. No. 3,874,729 discloses lounge furniture that has a construction that is similar to the present invention. There are, however, critical differences between Blodee and the present invention. While Blodee teaches a fiber covering that covers much of the base of the chair, it does not disclose the use of foam padding on the underside of the base of the chair. This foam padding is essential for the use of the chair as a sexual facilitating device because the fiber covering alone does not provide a comfortable support surface suitable for sitting and reclining.

Blodee also fails to teach any of the key structural features that facilitate the use of the chair in sexual activities. Blodee does not teach a base frame having a depression on either side between the front and rear legs of the chair. Blodee does not teach building front and rear legs that are angled outward from perpendicular to the ground. Blodee also does not teach a back support having an upper back support foam padding to protect the back support when the chair device is in the inverted position. Finally, Blodee does not teach a back support having a pair of leg clearance indentations that facilitate proper use of the chair device, as described below. These various structural improvements are disclosed in detail in the following detailed disclosure.

The prior art teaches various pieces of well known furniture, and the prior art also teaches various sexual contraptions for facilitating sexual relations. However, the prior art does not teach a device that appears to be ordinary furniture, that functions as ordinary furniture, and that can be repositioned for use as a sexual facilitation device. The present invention fulfills these needs and provides further related advantages as described in the following summary.

SUMMARY OF THE INVENTION

The present invention teaches certain benefits in construction and use which give rise to the objectives described below.

The present invention provides a chair device for facilitating sexual intimacy between a person and his or her sexual partner. The chair device closely resembles an ordinary chair, having a base, a back support, and a base support means for supporting the chair device in an upright position. In the upright position, the chair device supports a person in a sitting position. When the chair device is turned over to an inverted position, the chair device is supported by the back support and an arm supporting means. In this inverted position, the base provides a reclining surface having a base foam padding for comfortably supporting a person in a position that facilitates sexual intimacy with a sexual partner.

A primary objective of the present invention is to provide a chair device having advantages not taught by the prior art.

Another objective is to provide a chair device that resembles and functions as an ordinary chair, thereby allowing it to be left in plain view without causing the owner embarrassment.

A further objective is to provide a chair device that can be inverted to position a reclining surface having a base foam padding for comfortably supporting a person in a position that facilitates sexual intimacy with a sexual partner.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
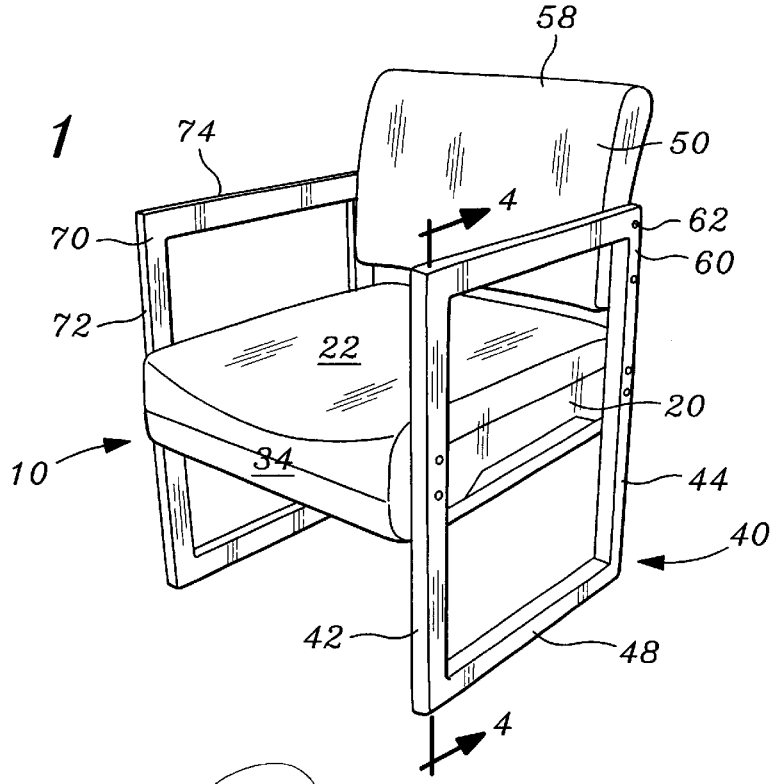
FIG. 1 is a perspective view of a first embodiment of the present invention in the upright position.

The above described drawing figures illustrate the invention, a chair device 10 for facilitating sexual intimacy between a person 12 and a sexual partner 14. The chair device 10 includes a base 20, a back support 50, and a means for supporting 40 the base 20 in an upright position ("base support means 40"). When the chair device 10 is in the upright position, the base 20 and back support 50 cooperate to support a person 12 in a sitting position. When the chair device 10 is turned over to an inverted position, the chair device 10 is supported by the back support 50 and a means for providing an arm support 70 ("arm supporting means 70"). In so this inverted position, the chair device 10 supports the sexual partner 14 in a position that facilitates sexual intimacy with the person 12.

In a first embodiment, shown in FIG. 1, when the chair device 10 is in the upright position it appears and functions just like an ordinary chair. When the person 12 sits in the chair device 10, he or she is supported in a seated position by a sitting surface 22 of the base 20 and the back support 50. The base support means 40 supports the base 20 above the ground and the arm supporting means 70 provides an arm rest for the person 12 to rest his or her arms. In the preferred embodiment, the back support 50 is attached to the base 20 with the arm supporting means 70.

Figure 2:
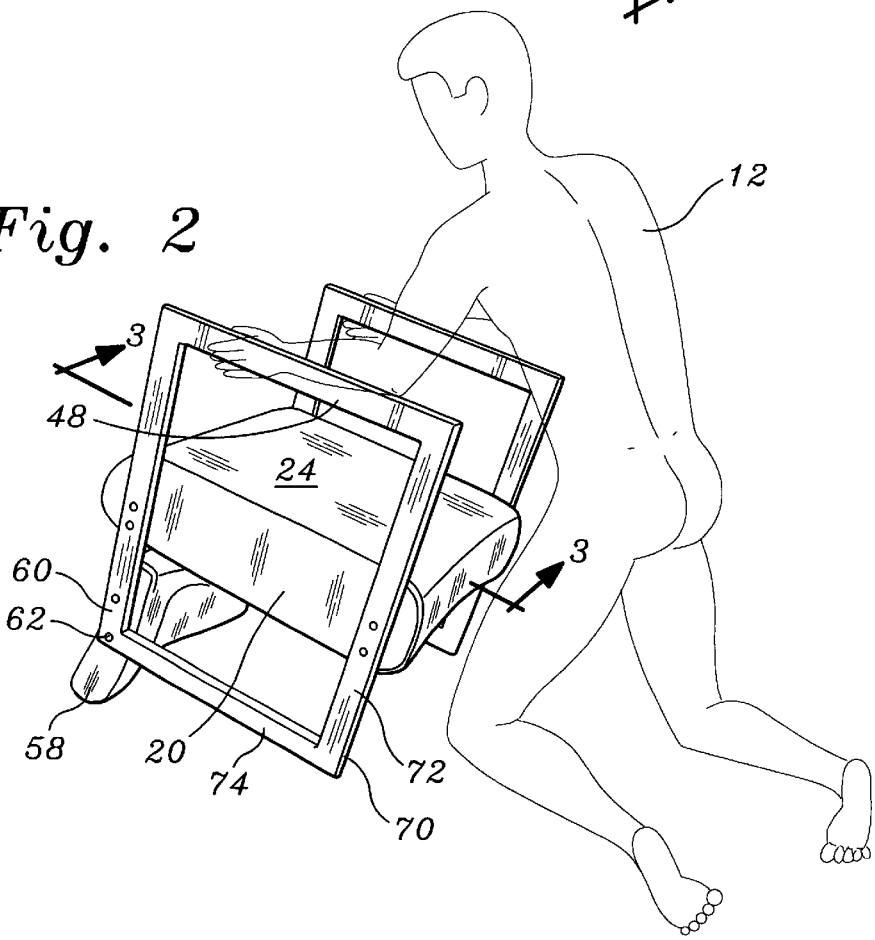
FIG. 2 is a perspective view thereof showing the chair device in an inverted position with a reclining surface of a base of the chair device facing upwards for use, the view further showing a man positioned for sexual intimacy.

As shown in FIG. 2, the chair device 10 can be turned over to the inverted position for facilitating sexual intimacy. As shown in FIGS. 1–4, the base 20 of the chair device 10 has a reclining surface 24 opposite the sitting surface 22. Most of the base 20, including both the sitting surface 22 and the reclining surface 24, are covered with a base foam padding 32, preferably a soft and resilient foam padding that is at least 1 inch thick. It is critical that the reclining surface 24 is covered with the base foam padding 32 to provide a surface that comfortably supports the sexual partner 14. This feature is not shown in the prior art because it would not ordinarily make sense to cover the bottom of a chair with padding.

Base

Figure 3:
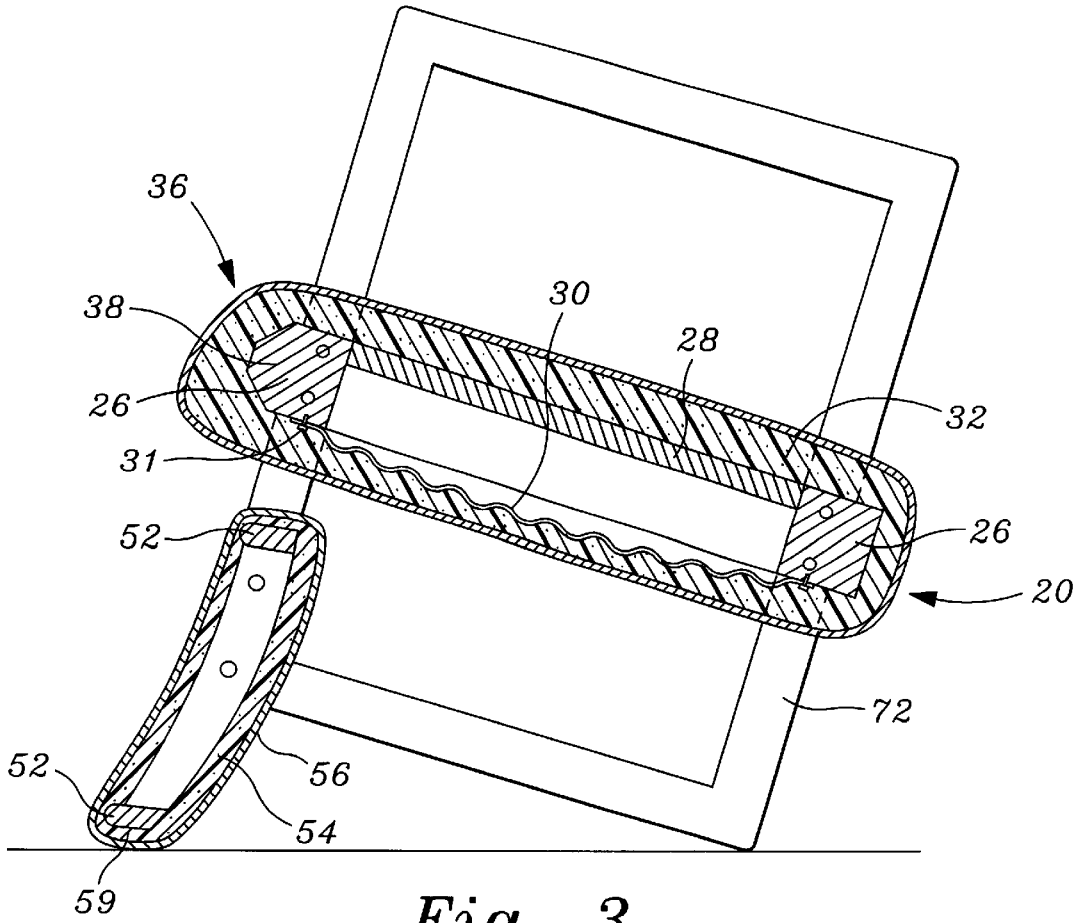
FIG. 3 is a sectional view taken along line 3—3 in FIG. 2.
Figure 4:
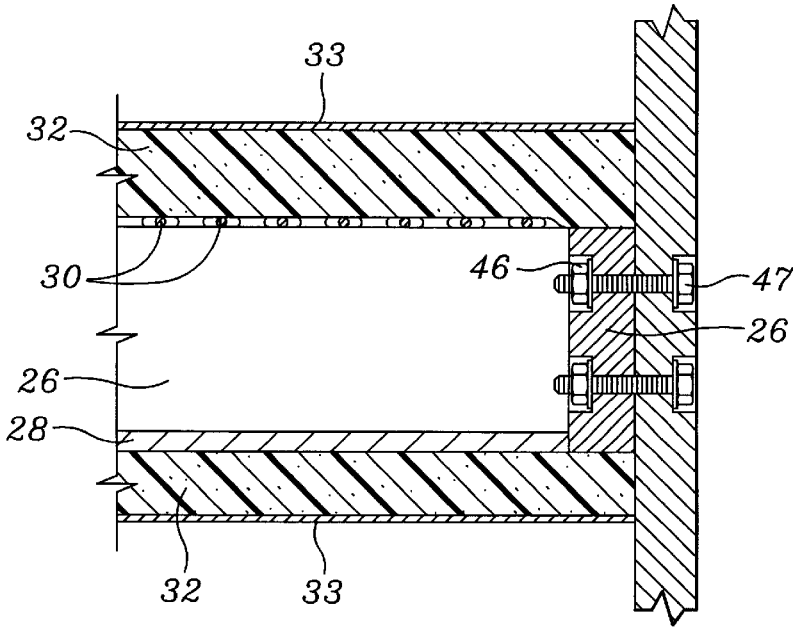
FIG. 4 is a sectional view taken along line 4—4 in FIG. 1.
Figure 7:
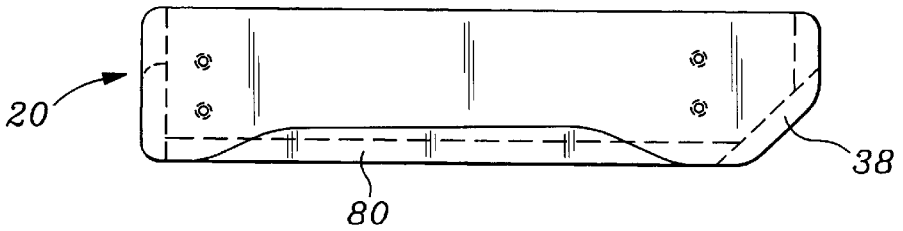
FIG. 7 is a side elevational view of a base frame of the base.
Figure 8:
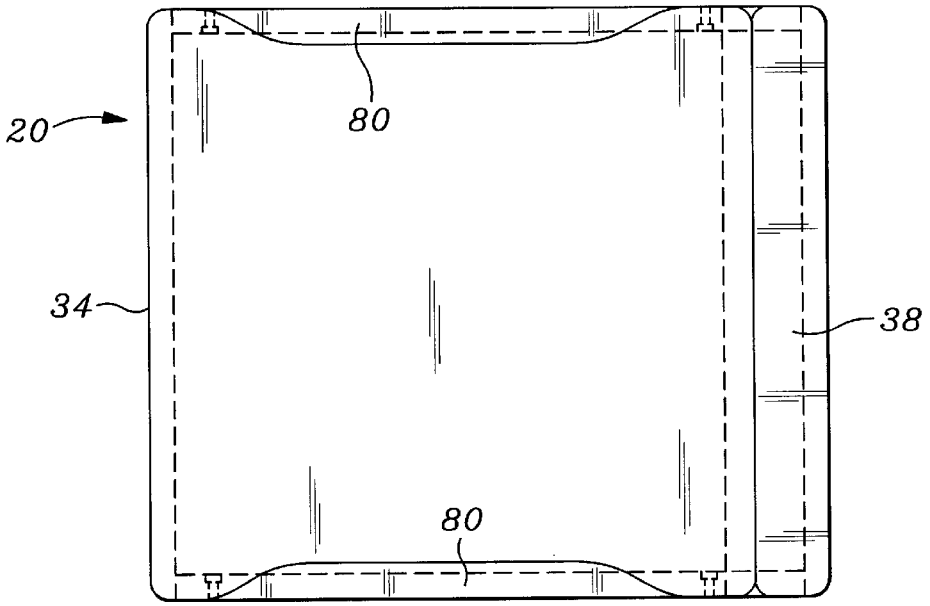
FIG. 8 is a bottom plan view thereof.

As shown in FIGS. 3, 7, and 8, the base 20 includes a roughly square wooden base frame 26 having a wooden base board 28 mounted within the base frame 26, preferably with dowels. A plurality of springs 30 spans the top of the base frame 26, each spring 30 being attached to the base frame 26 with a pair of pins 31. In its preferred embodiment, the base foam padding 32 is wrapped around the base frame 26, the base board 28, and the springs 30. In its most preferred embodiment, the base foam padding 32 is preferably approximately 1 inch thick over the sitting surface 22 and approximately 2 inches thick over the reclining surface 24. The base foam padding 32 is covered by a base upholstery 33 made of material suitable for furniture, preferably leather.

The base 20 preferably has a front base surface 34 and a back base surface 36. The front and back base surfaces 34 and 36 extend between the sitting surface 22 and the reclining surface 24 and are preferably also covered by the base foam padding 32. The front base surface 34 is preferably covered with the base foam padding 32, the base foam padding 32 preferably being approximately 1 inch thick. The back base surface 36 is also preferably covered with the base foam padding 32, the base foam padding 32 being approximately 2 inches thick. In its most preferred embodiment, the base frame 26 further includes an extending portion 38 that supports and extends the back base surface 36 to form a rounded edge to the base 20. It is preferred that the back base surface 36 have the extending portion 38 and is covered by the base foam padding 32 because the back base surface 36 provides support for the sexual partner 14 in various sexual positions.

Front and Rear Legs

As described above and as shown in FIG. 1, the chair device 10 includes the base support means 40 for supporting the base 20 in an upright position in which the sitting surface 22 is facing up and generally horizontal. The base support means 40 preferably includes two front legs 42 and two rear legs 44 that extend generally downwards from the base frame 26 to support the chair device 10 above the ground. The front and rear legs 42 and 44 are preferably fastened to the base frame 26 with connect bolts 47 and tee nuts 46. The front and rear legs 42 and 44 are preferably 16.5 inches long and spaced 21 inches apart. Since this aspect of the invention is similar to the prior art, those skilled in the art can devise many base support means 40 that fulfill the needs of this invention. The primary limitations imposed by the specific design of this invention are that there are preferably no cross supports positioned laterally between the front legs 42 or between the rear legs 44.

Figure 6:
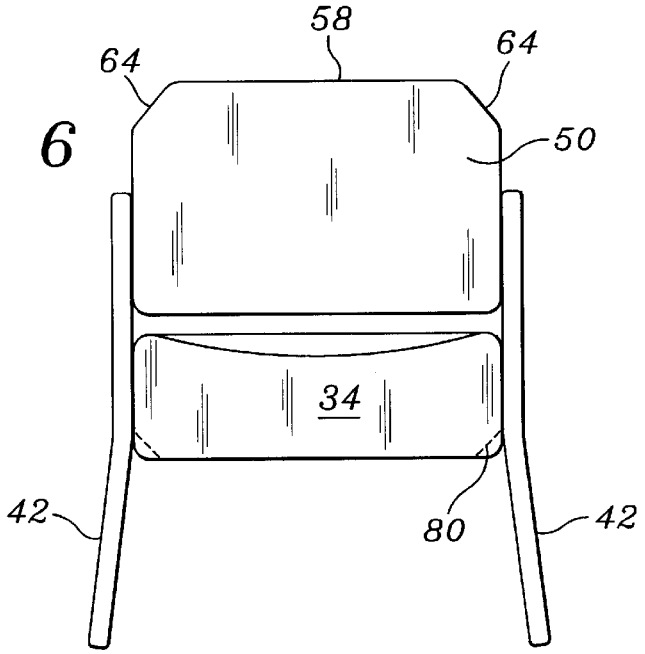
FIG. 6 is a front elevational view of a preferred embodiment of the present invention, the view showing a pair of front legs and a pair of rear legs that are angled outwards from perpendicular with the ground, the view further showing a pair of leg clearance indentations in the back support.

In the preferred embodiment, as shown in FIG. 6, the two front legs 42 and two rear legs 44 are angled outward from perpendicular with the ground so that the longitudinal cross braces 48 are further apart from each other then they would be if the two front legs 42 and two rear legs 44 were perpendicular to the ground. In this embodiment, as shown in FIGS. 6–10, the base frame 26 has a depression 80 on each side between the front and rear legs 42 and 44. Each longitudinal cross brace 48 and its respective depression 80 together defining a leg receiving area 82 that is sized and shaped to allow the sexual partner 14, preferably a woman, to straddle the chair device 10 with her legs through the leg receiving area 82, as shown in FIG. 10 and as further discussed below.

Longitudinal Cross Support

Figure 5:
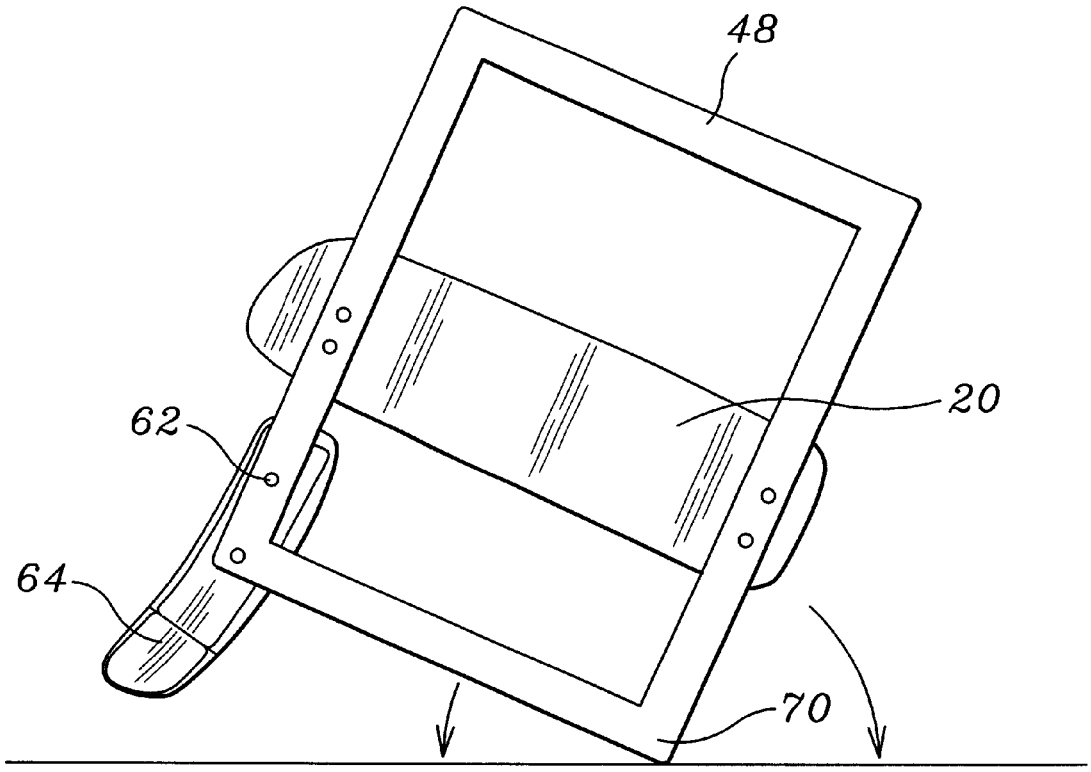
FIG. 5 is a side elevational view thereof showing the chair being lifted into an arm support with the arm support functioning as a fulcrum to allow the chair device to rock back and forth for facilitating sexual relations.
Figure 9:
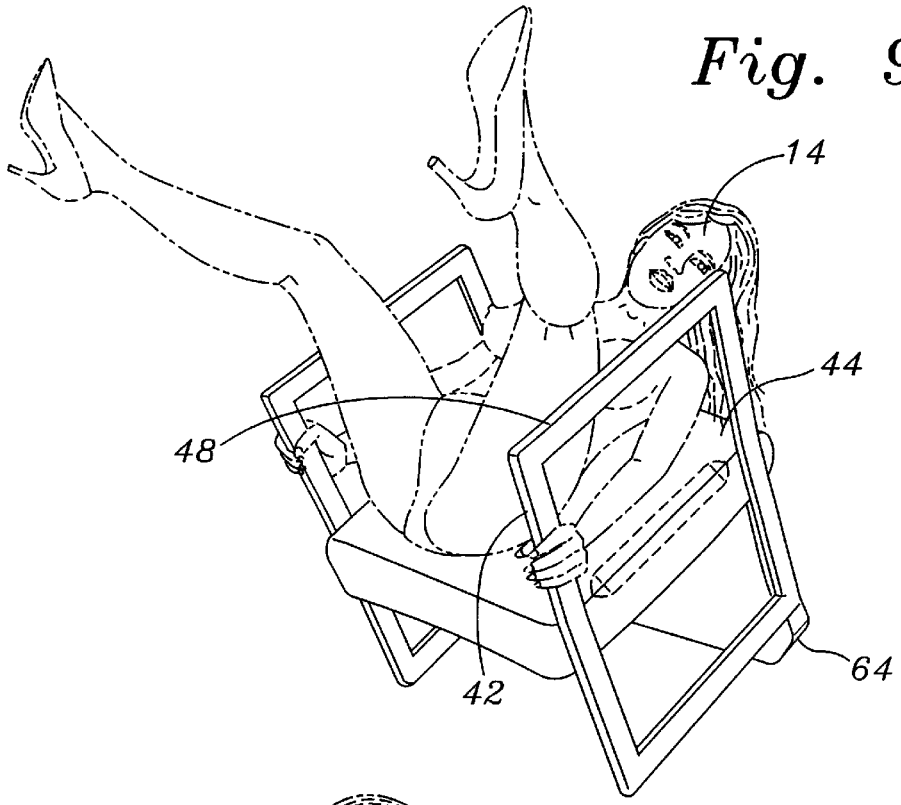
FIG. 9 is a perspective view of the preferred embodiment of the present invention showing the chair device in the inverted position with a woman on the reclining surface positioned for sexual intimacy.
Figure 10:
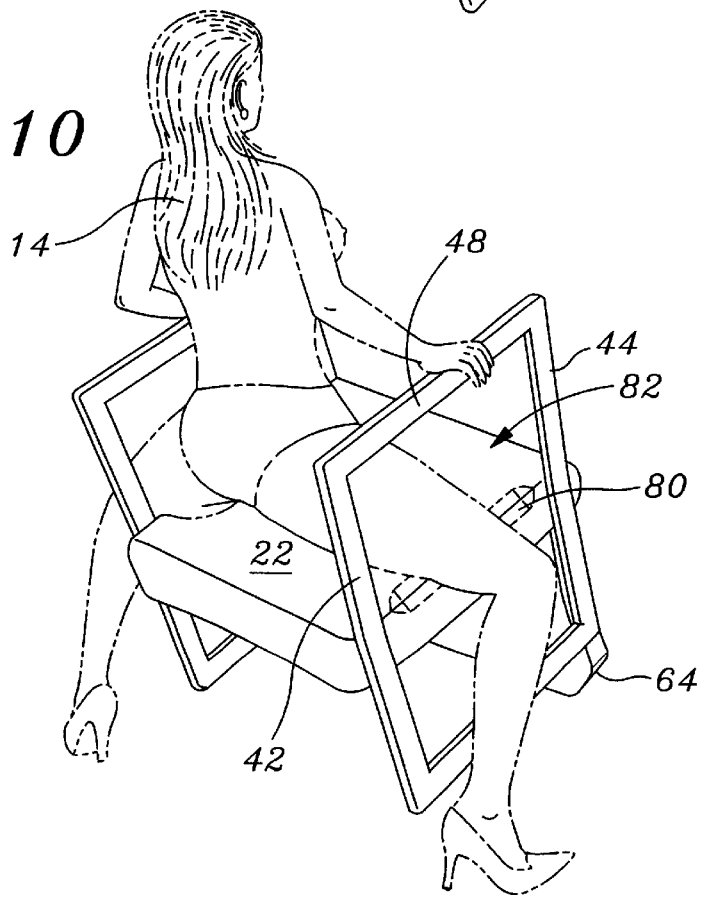
FIG. 10 is a perspective view thereof with the woman in an upright position with her legs positioned between the base and a longitudinal cross support.

As shown in FIGS. 2, 9, and 10, each of the front legs 42 is preferably connected to one of the rear legs 44 with a longitudinal cross support 48, thereby providing support and leverage for various sexual activities when the chair device 10 is in the inverted position. As shown in FIG. 2, the person 12 can use the longitudinal cross support 48 for support while engaging in sexual intimacy. While the person 12 holds the longitudinal cross support 48, the person 12 can lever the chair device 10 off of the back support 50 so that it is pivotally supported by the arm support 70, as shown in FIG. 5. As shown in FIG. 9, the sexual partner 14 grasps the front legs 42 for leverage to manipulate her position on the chair device 10 while her head rests on the front base surface 34 supported by the extending portion 38. As shown in FIG. 10, the longitudinal cross support 48 can be used for support and leverage when the sexual partner 14 is sitting astride the chair device 10, as described below. The longitudinal cross support 48 also serves to provide the chair device 10 with additional structural support and strength.

Back Support

As shown in FIG. 1, the chair device 10 also includes a back support 50 for cooperating with the base 20 to support the person 12 in a sitting position when the chair device 10 is in its upright position. The back support 50 is preferably a rectangular back support frame 52 made of wood, the back support frame 52 preferably being arched backwards to provide a more comfortable back supporting contour. The back support frame 52 is preferably covered with a sheet of back support foam padding 54, which is covered with a back support upholstery 56. The back support upholstery 56 preferably matches the base upholstery 33. In its preferred embodiment, the rear legs 44 extend upwardly past the base frame 26 to form a back frame supporting portion 60. The back support frame 52 is attached to the back frame supporting portion 60 with a plurality of back support bolts 62, thereby supporting the back support frame 52 in its proper position.

Arm Supports

As shown in FIG. 1, the chair device 10 further includes a means for supporting 70 the arms of the person 12 while the person 12 is sitting on the chair device 10 and the chair device 10 is in the upright position. As shown in FIGS. 2 and 3, when the chair device 10 in the inverted position the arm supporting means 70 cooperates with the back support 50 to support the chair device 10 above the ground. When the chair device 10 is in the inverted position, the reclining surface 24 is facing up, thereby providing a surface for the sexual partner 14 to recline while engaged in sexual intimacy with the person 12. In its most preferred embodiment, the back support frame 52 has an upper back support surface 58 that contacts the ground when the chair device 10 is in the inverted position. The upper back support surface 58 is preferably covered by the back support foam padding 54 to protect the back support upholstery 56 when the chair device 10 is in the inverted position.

In the preferred embodiment, the arm supporting means 70 is a pair of arm supports. Each of the arm supports 70 are formed by an upwardly extending portion 72 of each of the front legs 42, preferably extending between 9.5 and 13.5 inches above the base 20. Each of the upwardly extending portions 72 is preferably connected to one of the back frame supporting portion 60 with an arm rest cross brace 74 similar to the longitudinal cross support 48. Each of the upwardly extending portions 72 is preferably connected to the back frame supporting portion 60 adjacent the back support frame 52. In this preferred embodiment, as shown in FIGS. 1 and 3, the upwardly extending portion 72, the arm rest cross brace 74, the back frame supporting portion 60, the front and rear legs 42 and 44, and the longitudinal cross support 48 are all one structure, each section being joined together to form a pair of roughly square frames attached to both the base 20 and the back support frame 52, thereby providing support for the chair device 10 in both upright and inverted positions. The various sides of these frames are preferably separate sections of wood, all interconnected with joints known as mortise and tenons, a construction technique well known in the art. The visible wood is preferably oak or other visually pleasing wood, while the portions that are covered with upholstery can be constructed of less expensive wood such as poplar. All of the construction techniques and materials used, in both the frame, the padding, and the upholstery, are well known in the art and can be devised or altered by those skilled in the art without deviating from the inventive concept hereby described.

As shown in FIG. 5, the arm supporting means 70 preferably provides a fulcrum when supporting the chair device 10 in the inverted position. As a fulcrum, the arm supporting means 70 allows the person 12 to rock the chair device 10 backwards and forwards on the arm supporting means 70, thereby changing the angle of the reclining surface 24 and the position of the sexual partner. To facilitate this rocking motion, the back support 50 preferably includes a pair of leg clearance indentations 64. As shown in FIG. 6, each of the leg clearance indentations 64 is cut into each of the top corners of the back support frame 52 along the upper back support surface 58. When the person 12 is standing behind the back support 50 and rocking the chair device 10, the person 12 is able to tilt the chair device 10 without causing the back support 50 to bump into the legs of the person 12. The extra clearance provided by the leg clearance indentations 64 is important to the proper use of the chair device 10 in certain sexually intimate positions.

The Method of Using the Chair Device

The invention includes the method of using the chair device 10 to facilitate sexual intimacy between the person 12 and the sexual partner 14. The chair device 10 is initially placed in the upright position for use as an ordinary chair, as shown in FIG. 1. In the upright position, the chair device 10 is not notably different than an ordinary chair.

In the preferred method, when the person 12 and his or her sexual partner 14 wish to utilize the chair device 10 for sexual activity, the person 12 simply flips the chair to its inverted position, so the chair is supported by the back support 50 and the arm supports 70, as described above. In this position, the chair device 10 can be used to facilitate many forms of sexual intimacy.

As shown in FIG. 9, in one position the sexual partner 14, preferably a woman, lies with her back upon the reclining surface 24, the chair device 10 thereby positioning her for sexual intimacy. In this position, the woman 14 may lie with her head either supported by or hanging over the extending portion 38 supporting the back base surface 36. The woman 14 may also reach up and grasp the longitudinal cross support 48 or the front legs 42, thereby gaining leverage for sexual activity. The person 12, preferably a man, is positioned as shown in FIG. 2, also grasping the longitudinal cross support 48 for support and leverage for sexual activity. In this position, the man 12 can rock the chair device 10, as shown in FIG. 5, to thereby manipulate the position of the woman 14 during sexual intimacy.

As shown in FIG. 10, in an alternative position the woman 14 is positioned to straddle the man 12 (in this figure, the man is not shown) when he is lying on his back on the reclining surface 24. The woman 14 is positioned to that her legs are within the leg receiving area 82 described above. In this position the woman 14 can support herself by standing on the ground and by leaning on the longitudinal cross braces 48. It is important that the two front legs 42 and two rear legs 44 are angled outward from perpendicular with the ground so that the longitudinal cross braces 48 are further apart, thereby providing adequate room for the legs of the woman 14. The depressions 80 on each side between the base frame 26 provide additional room for the legs of the woman 14.

In another alternative position, not shown in the drawings, the woman 14 lies face down with her stomach on the reclining surface 24 with her legs against the back base surface 36 and the back of the back support 50. The extending portion 38 provides a rounded and padded surface of the woman 14 to lie across with comfort. The woman 14 may grasp the front legs 44 of the chair device 10 for increased leverage and comfort. The chair device 10 supports the woman 14 for sexual intimacy with the man 12 positioned behind her, standing near the back support 50 and leaning on the longitudinal cross support 48. The man 12 is then positioned to rock the chair device 10, as shown in FIG. 5. The back support 50 does not bump into the legs of the man 12 when the chair device 10 is being rocked because the leg clearance indentations 64 provide the required clearance.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A chair device for facilitating sexual intimacy between a person and his or her sexual partner, the chair device comprising:

a base having a sitting surface and an opposing reclining surface, the sitting surface and the reclining surface both being covered with a base foam padding, the base foam padding being at least one inch thick;

a means for supporting the base in an upright position when the chair device is in an upright position and the sitting surface is facing up and generally horizontal;

a back support for cooperating with the base to support the person in a sitting position when the chair device is in the upright position; and a means for supporting the arms of the person while the person is sitting on the chair device, the back support and the arm supporting means being positioned to support the chair device when the chair device is in an inverted position in which the reclining surface is facing up, thereby providing a surface for the sexual partner to recline while engaged in sexual intimacy with the person.

2. The chair device of claim 1 wherein the base supporting means includes two front legs and two rear legs, each front leg being connected to its adjacent rear leg with a longitudinal cross-brace, the front and rear legs and the longitudinal cross braces together providing a railing on either side of the reclining surface, whereby the railings provides support and leverage for various sexual activities when the chair device is in the inverted position;

wherein the base includes a base frame that connects the two front legs and the two rear legs, the base frame having a depression on each side between the front and rear legs; and wherein the two front legs and the two rear legs are angled outward from perpendicular with the ground, the longitudinal cross brace and the depression together defining a leg receiving area.

3. The chair device of claim 2 wherein the back support is a back support frame attached to an upwardly extending portion of the rear legs, the back support frame having an upper back support surface that contacts the ground when the chair device is in the inverted position, the upper back support surface being covered with an upper back support foam padding.

4. The chair device of claim 3 wherein the back support frame includes a pair of leg clearance indentations at both ends of the upper back support surface.

5. The chair device of claim 1 further comprising a front base surface and a back base surface, the front and back base surfaces being covered by the base foam padding.

6. The chair device of claim 5 wherein the back base surface includes an extending portion that extends beyond the two rear legs; and wherein the base foam padding is at least two inches thick over the extending portion.

7. A method for using a chair device to facilitate sexual intimacy between a person and a sexual partner, the method comprising the steps of:

a) providing a chair device comprising:

a base having a sitting surface and an opposing reclining surface, the sitting surface and the reclining surface both being covered with a base foam padding;

a means for supporting the base in an upright position when the chair device is in an upright position and the sitting surface is facing up and generally horizontal;

a back support for cooperating with the base to support the person in a sitting position when the chair device is in the upright position; and a means for supporting the arms of the person while the person is sitting on the chair device, the back support and the arm supporting means being positioned to support the chair device when the chair device is in an inverted position in which the reclining surface is facing up, thereby providing a surface for the sexual partner to recline while engaged in sexual intimacy with the person, b) positioning the chair device in the inverted position with the reclining surface facing up and the base being supported by the arm support and the back support;

c) positioning the sexual partner on the reclining surface; and d) positioning the person for sexual intimacy with the sexual partner.

8. A method for using a chair device to facilitate sexual intimacy between a person and a sexual partner, the method comprising the steps of:

a) providing a chair device comprising:

a base having a sitting surface and an opposing reclining surface, the sitting surface and the reclining surface both being covered with a base foam padding;

two front legs and two rear legs for supporting the base above the ground when the chair device is in an upright position in which the sitting surface is facing up and generally horizontal, each front leg being connected to its adjacent rear leg with a longitudinal cross-brace;

the base including a base frame that connects the two front legs and the two rear legs, the base frame having a depression on each side between the front and rear legs;

the two front legs and the two rear legs being angled outward from perpendicular with the ground;

each of the longitudinal cross braces cooperating with one of the depressions to defining a leg receiving area;

a back support that, with the base, is positioned to support the person in a sitting position when the chair device is in the upright position, the back support being positioned to cooperating with an arm support to support the chair device in an inverted position when the reclining surface is facing up;

b) positioning the chair device in the inverted position with the reclining surface facing up and the base being supported by the arm support and the back support;

c) positioning the sexual partner on the reclining surface; and d) positioning the person for sexual intimacy with the sexual partner, each of the legs of the person being positioned within one of the leg receiving areas.

* * * * *